US012379107B2

(12) United States Patent
Mohammed et al.

(10) Patent No.: US 12,379,107 B2
(45) Date of Patent: Aug. 5, 2025

(54) COMBUSTOR NOZZLE, COMBUSTOR AND GAS TURBINE INCLUDING SAME

(71) Applicant: DOOSAN ENERBILITY CO., LTD., Changwon-si (KR)

(72) Inventors: Afzal Pasha Mohammed, Palm Beach Gardens, FL (US); Jose Grana-Otero, Kent, WA (US); Dong Sik Han, Changwon-si (KR); Ho Keun Kim, Daejeon (KR); Young Jun Shin, Seongnam-si (KR)

(73) Assignee: Doosan Enerbility Co., Ltd., Changwon-si (KR)

( * ) Notice: Subject to any disclaimer, the term of this patent is extended or adjusted under 35 U.S.C. 154(b) by 0 days.

(21) Appl. No.: 18/527,025

(22) Filed: Dec. 1, 2023

(65) Prior Publication Data

US 2025/0180211 A1 Jun. 5, 2025

(51) Int. Cl.
*F23R 3/28* (2006.01)
*F23R 3/12* (2006.01)

(52) U.S. Cl.
CPC .... *F23R 3/286* (2013.01); *F23D 2900/14021* (2013.01); *F23R 3/12* (2013.01)

(58) Field of Classification Search
CPC ... F23R 3/286; F23R 3/12; F23D 2900/14021
See application file for complete search history.

(56) References Cited

U.S. PATENT DOCUMENTS 9,366,440 B2 6/2016 Berry
9,528,702 B2 12/2016 Boardman et al.
2006/0156730 A1 7/2006 Tuck et al.
2010/0064694 A1 3/2010 Dodo et al.
2010/0186413 A1 7/2010 Lacy et al.
2010/0192579 A1 8/2010 Boardman et al.
2010/0212322 A1* 8/2010 York ..... F23D 14/64 60/738
2011/0073684 A1 3/2011 Johnson et al.
(Continued)

FOREIGN PATENT DOCUMENTS

EP 2145131 B1 1/2010
JP 2008-281329 A 11/2008
(Continued)

*Primary Examiner* — Todd E Manahan
*Assistant Examiner* — Alyson Joan Harrington
(74) *Attorney, Agent, or Firm* — Shook, Hardy & Bacon L.L.P.

(57) ABSTRACT

Disclosed herein is a nozzle for a combustor that burns fuel containing hydrogen. The nozzle includes a cylindrical tube through which air and fuel flow, and the cylindrical tube has an inlet formed at a longitudinal end thereof for introduction of a first fluid (e.g., compressed air) into the cylindrical tube. The cylindrical tube has one or more supply ports formed on a circumferential surface of the cylindrical tube for introduction of a second fluid (e.g., fuel such as hydrogen) into the cylindrical tube. The cylindrical tube has at least one fuel/air separator disposed interior of the longitudinal end, the fuel/air separator operative to cause a flow of the second fluid to be sandwiched between two flows of the first fluid before the first and second fluids subsequently mix inside the cylindrical tube. The nozzle may be included in a combustor of a gas turbine engine.

19 Claims, 10 Drawing Sheets

(56) References Cited

U.S. PATENT DOCUMENTS

| | | | | |
|---|---|---|---|---|
| 2011/0094239 | A1 | 4/2011 | Koizumi et al. | |
| 2012/0198856 | A1 | 8/2012 | Uhm et al. | |
| 2013/0036743 | A1 | 2/2013 | Khan et al. | |
| 2013/0186092 | A1 | 7/2013 | Bathina et al. | |
| 2013/0192234 | A1 | 8/2013 | Stewart et al. | |
| 2013/0232979 | A1* | 9/2013 | Singh | F23R 3/286 60/737 |
| 2014/0216040 | A1 | 8/2014 | Johnson et al. | |
| 2014/0216049 | A1 | 8/2014 | Keener et al. | |
| 2016/0040883 | A1 | 2/2016 | Asai et al. | |
| 2017/0089583 | A1 | 3/2017 | Simmons | |
| 2017/0175636 | A1 | 6/2017 | Hughes et al. | |
| 2017/0268780 | A1 | 9/2017 | Purcell et al. | |
| 2017/0343216 | A1 | 11/2017 | McMahan et al. | |
| 2018/0372318 | A1 | 12/2018 | Bolanos et al. | |
| 2020/0072466 | A1 | 3/2020 | Akiyama et al. | |

FOREIGN PATENT DOCUMENTS

| | | | |
|---|---|---|---|
| JP | 2014013100 | A | 1/2014 |
| JP | 2014055536 | A | 3/2014 |
| JP | 5538113 | B2 | 7/2014 |
| JP | 5614893 | B2 | 10/2014 |
| JP | 2014185831 | A | 10/2014 |
| JP | 5630424 | B2 | 11/2014 |
| JP | 2015-014400 | A | 1/2015 |
| JP | 2016-075548 | A | 5/2016 |
| JP | 5926635 | B2 | 5/2016 |
| JP | 5939942 | B2 | 6/2016 |
| JP | 6022389 | B2 | 11/2016 |
| JP | 6106441 | B2 | 3/2017 |
| JP | 2018-004138 | A | 1/2018 |
| JP | 6262616 | B2 | 1/2018 |
| JP | 6397193 | B2 | 9/2018 |
| WO | 2015037295 | A1 | 3/2015 |
| WO | 2016104725 | A1 | 6/2016 |

* cited by examiner

COMBUSTOR NOZZLE, COMBUSTOR AND GAS TURBINE INCLUDING SAME

TECHNICAL FIELD

Exemplary embodiments relate to a combustor nozzle for operation in association with a combustor and gas turbine engine including the same. The combustor may use at least one of hydrogen fuel and natural gas fuel.

BACKGROUND

A gas turbine engine is a power engine that mixes air compressed by a compressor with fuel for combustion and rotates a turbine with hot gas produced by the combustion. The gas turbine engine is used to drive a generator, an aircraft, a ship, a train, etc.

The gas turbine engine typically includes a compressor, a combustor, and a turbine. The compressor sucks and compresses outside air, and then transmits the compressed air to the combustor. The combustor mixes the compressed air flowing thereinto from the compressor with fuel and burns a mixture thereof to generate high pressure and high temperature combustion gas. The combustion gas produced by the combustion is discharged to the turbine. Turbine blades in the turbine are rotated by the combustion gas, thereby generating power. The generated power is used in various fields, such as generating electric power and actuating machines.

Fuel is injected through nozzles installed in each combustor section of the combustor, and the nozzles allow for injection of gas fuel and/or liquid fuel. In recent years, it is recommended to use hydrogen fuel or fuel containing hydrogen to inhibit or reduce the emission of carbon dioxide given that hydrogen is a carbon-free fuel.

However, while use of hydrogen fuel or fuel containing hydrogen enables the desired effect of inhibiting or reducing emission of carbon dioxide, problems can occur owing to the high combustion rate of hydrogen. That is, when hydrogen is introduced as a fuel, if the hydrogen is not thoroughly mixed with the compressed air generated by the compressor, the hydrogen can ignite prematurely or separately from the compressed air causing flashback in the nozzles or fuel/air mixing tubes. Such flashbacks can damage components of the gas turbine engine, and such flashbacks can lead to inefficient gas turbine engine operation owing to inconsistent energy to the gas turbine engine system. In addition, as proper pressure in the gas turbine engine system is necessary for efficient operation, premature or inefficient combustion of hydrogen fuel not properly mixed with compressed air can result in undesired pressure drops in the gas turbine engine system. Another problem owing to inefficient hydrogen fuel combustion is the production of nitrogen oxides (NOx). When air is heated to high temperatures, nitrogen which naturally occurs in air, combines with oxygen to produce NOx. Combusting hydrogen fuels mixed with compressed air when the hydrogen fuel is not properly mixed with the compressed air prior to combustion can result in over heating the compressed air which, in turn, can result in production of undesired levels of NOx.

There is a need in the art for a gas turbine engine fuel nozzle or fuel/air mixing tube in which fuels are mixed with compressed air in a manner that allows for efficient combustion of the fuels for improved gas turbine engine operation and that inhibits production of undesired byproducts.

SUMMARY

Aspects of one or more exemplary embodiments provide a combustor nozzle that enables uniform mixing of fuel and air, a combustor, and a gas turbine engine including the same.

Additional aspects will be set forth in part in the description which follows and, in part, will become apparent from the description, or may be learned by practice of the exemplary embodiments.

According to an aspect of an exemplary embodiment, there is provided a nozzle or fuel/air mixing tube for a combustor that improves the mixing of fuels with compressed air and that enables improved combustion of fuel/air mixtures. According to one aspect of the exemplary embodiment, the nozzle is comprised of a cylindrical tube through which air and fuel flow. The cylindrical tube has an inlet formed at a longitudinal end thereof for introduction of a first fluid (e.g., compressed air) into the cylindrical tube. The cylindrical tube has one or more supply ports formed on a circumferential surface of the cylindrical tube for introduction of a second fluid (e.g., fuel such as hydrogen or fuels containing hydrogen) into the cylindrical tube. According to an aspect, the cylindrical tube has at least one fuel/air separator disposed interior of the longitudinal end, the fuel/air separator operative to cause a flow of the second fluid to be enveloped by a flow of first fluid before the first and second fluids subsequently mix inside the cylindrical tube.

According to one aspect of an exemplary embodiment, the fuel/air separator is further operative to cause a first layer of the first fluid to flow along an inner surface of the cylindrical tube, to cause a layer of the second fluid to flow along an inner surface of the first layer of the first fluid, and to cause a second layer of the first fluid to flow along an inner surface of the layer of the second fluid. The second fluid flows between the first and second layers of the first fluid after the first and second fluids pass through the fuel/air separator.

According to another aspect of an exemplary embodiment, the fuel/air separator may comprise an outer ring-shaped member where an outer surface of the outer ring-shaped member is situated spaced-apart from an inner surface of the cylindrical tube for allowing passage of the first fluid between the outer surface of the outer ring-shaped member and the inner surface of the cylindrical tube such that a layer of the first fluid forms along an inner circumferential surface of the cylindrical tube. The fuel/air separator may also include an inner ring-shaped member where the outer surface of the inner ring-shaped member is situated spaced-apart from an inner surface of the outer ring-shaped member for allowing passage of the second fluid between the outer surface of the inner ring-shaped member and the inner surface of the outer ring-shaped member such that a layer of the second fluid forms along an inner circumferential surface of the layer of the first fluid. According to an aspect, the inner ring-shaped member has an orifice for allowing the first fluid to pass through the orifice into the cylindrical tube such that a generally tube-shaped layer of the first fluid passes inside the layer of the second fluid. Thus, according to this aspect, the second fluid is sandwiched between the layer of the first fluid and the generally tube-shaped layer of the first fluid such that the second fluid is insulated from the inner circumferential surface of the cylindrical tube. Interaction of the layer of the first fluid, the layer of the second fluid and the generally tube-shaped layer of the first fluid downrange in the cylindrical tube away from the inlet formed at the longitudinal end of the cylindrical tube causes the first and second fluids to mix into a third fluid comprised of the first and second fluids.

According to another aspect of an exemplary embodiment, each of the one or more supply ports comprises a tube for communicating the second fluid into the fuel/air separator from outside the cylindrical tube. The tube is configured for communicating the second fluid into the space between the inner surface of the outer ring-shaped member and the outer surface of the inner ring-shaped member. The tube may be configured to enter the space between the inner surface of the outer ring-shaped member and the outer surface of the inner ring-shaped member at an angle for optimizing flow of the second fluid into the fuel/air separator.

According another aspect of an exemplary embodiment, the cylindrical tube may be combined with one or more other cylindrical tubes to form a multi-tube configuration for passing a mixture of the first and second fluids through each of the combined cylindrical tubes for combustion in a combustor burner. According to this aspect, each of the one or more additional cylindrical tubes may have an inlet formed at a longitudinal end thereof for introduction of the first fluid into each of the one or more other cylindrical tubes. Each of the one or more additional cylindrical tubes may have one or more supply ports formed on a circumferential surface of each of the one or more other cylindrical tubes for introduction of the second fluid into each of the one or more other cylindrical tubes, and each of the one or more other cylindrical tubes may have at least one fuel/air separator disposed interior of the longitudinal end, the fuel/air separator operative to cause a flow of the second fluid to be enveloped by a flow of first fluid before the first and second fluids subsequently mix inside the cylindrical tube.

According to an aspect of another exemplary embodiment, there is provided a combustor including a burner having a plurality of nozzles for injecting fuel and air, and a duct assembly coupled to one side of the burner to burn a mixture of the fuel and the air therein and transmit combustion gas to a turbine. Each of the nozzles may comprise a cylindrical tube through which air and fuel flow. The cylindrical tube may have an inlet formed at a longitudinal end thereof for introduction of a first fluid into the cylindrical tube, and the cylindrical tube may have one or more supply ports formed on a circumferential surface of the cylindrical tube for introduction of a second fluid into the cylindrical tube. According to an aspect, the cylindrical tube may have at least one fuel/air separator disposed interior of the longitudinal end, the fuel/air separator operative to cause a flow of the second fluid to be enveloped by a flow of first fluid before the first and second fluids subsequently mix inside the cylindrical tube.

According to a further exemplary embodiment, a gas turbine engine is provided including a compressor configured to compress air introduced thereinto from the outside, a combustor configured to mix fuel with the air compressed by the compressor for combustion, and a turbine having a plurality of turbine blades rotated by combustion gas produced by the combustion in the combustor. The combustor may include a burner having a plurality of nozzles for injecting the fuel and the air, and a duct assembly coupled to one side of the burner to burn a mixture of the fuel and the air therein and transmit the combustion gas to the turbine. According to an aspect, each of the nozzles may comprise a cylindrical tube through which air and fuel flow. The cylindrical tube may have an inlet formed at a longitudinal end thereof for introduction of a first fluid into the cylindrical tube, and the cylindrical tube may have one or more supply ports formed on a circumferential surface of the cylindrical tube for introduction of a second fluid into the cylindrical tube. According to an aspect, the cylindrical tube may have at least one fuel/air separator disposed interior of the longitudinal end, the fuel/air separator operative to cause a flow of the second fluid to be enveloped by a flow of first fluid before the first and second fluids subsequently mix inside the cylindrical tube. According still to this aspect, a plurality of such configured nozzles may be combined to form a multi-tube nozzle configuration for efficient mixing of fuel and compressed air for combustion in a combustion chamber of the combustor of the gas turbine engine.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
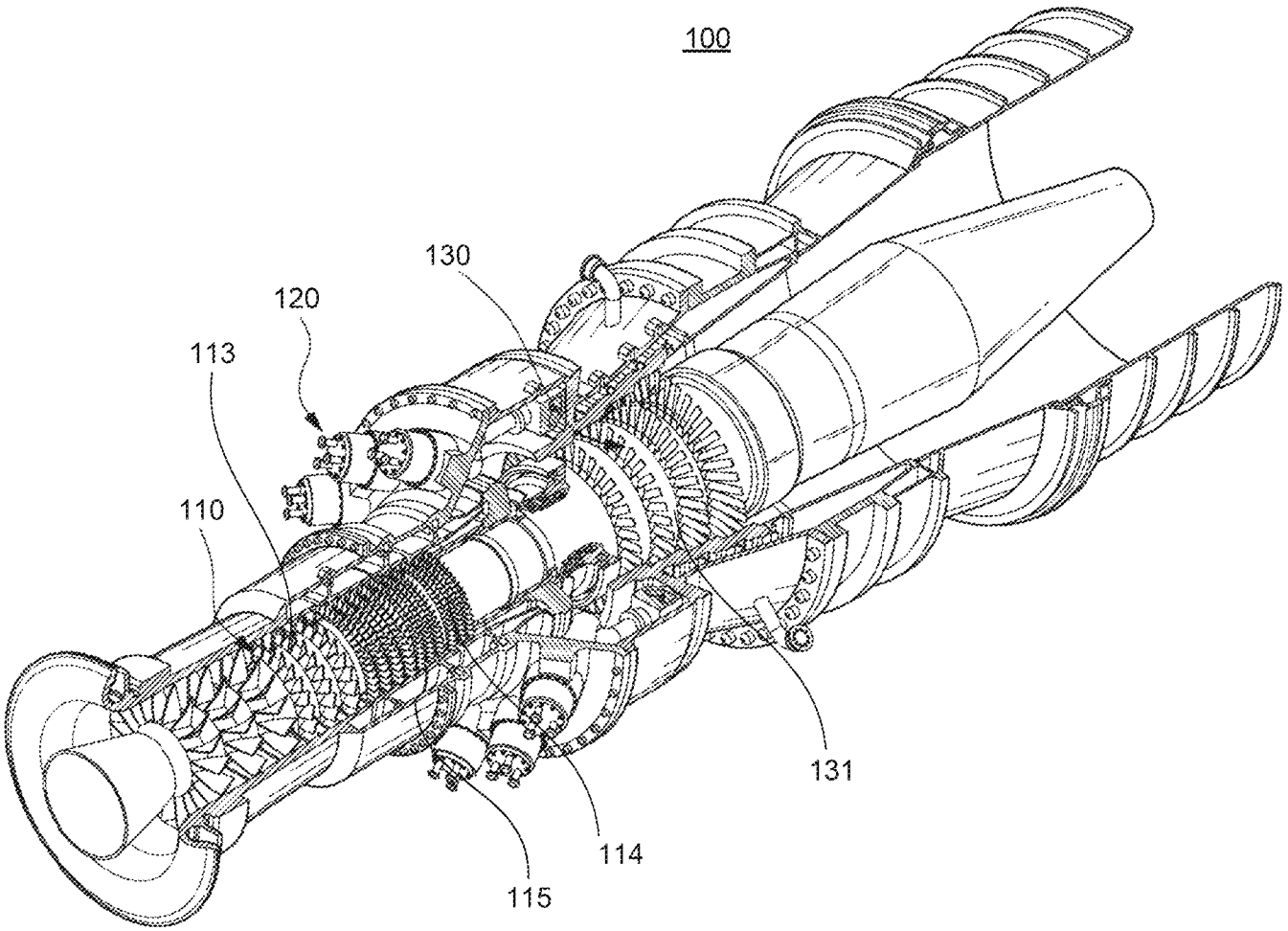
FIG. 1 is a perspective view illustrating an interior of a gas turbine engine according to an embodiment.

Various modifications and different embodiments will be described below in detail with reference to the accompanying drawings so that those skilled in the art can carry out the disclosure. It should be understood, however, that the present disclosure is not intended to be limited to the specific embodiments, but the present disclosure includes modifications, equivalents or replacements that fall within the spirit and scope of the disclosure as defined in the following claims.

The terminology used herein is for the purpose of describing specific embodiments only and is not intended to limit the scope of the disclosure. As used herein, the singular forms "a", "an" and "the" are intended to include the plural forms as well, unless the context clearly indicates otherwise.

In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. It should be noted that like reference numerals refer to like parts throughout various drawings and exemplary embodiments. In certain embodiments, a detailed description of functions and configurations well known in the art may be omitted to avoid obscuring appreciation of the disclosure by those skilled in the art. For the same reason, some components may be exaggerated, omitted, or schematically illustrated in the accompanying drawings.

Figure 2:
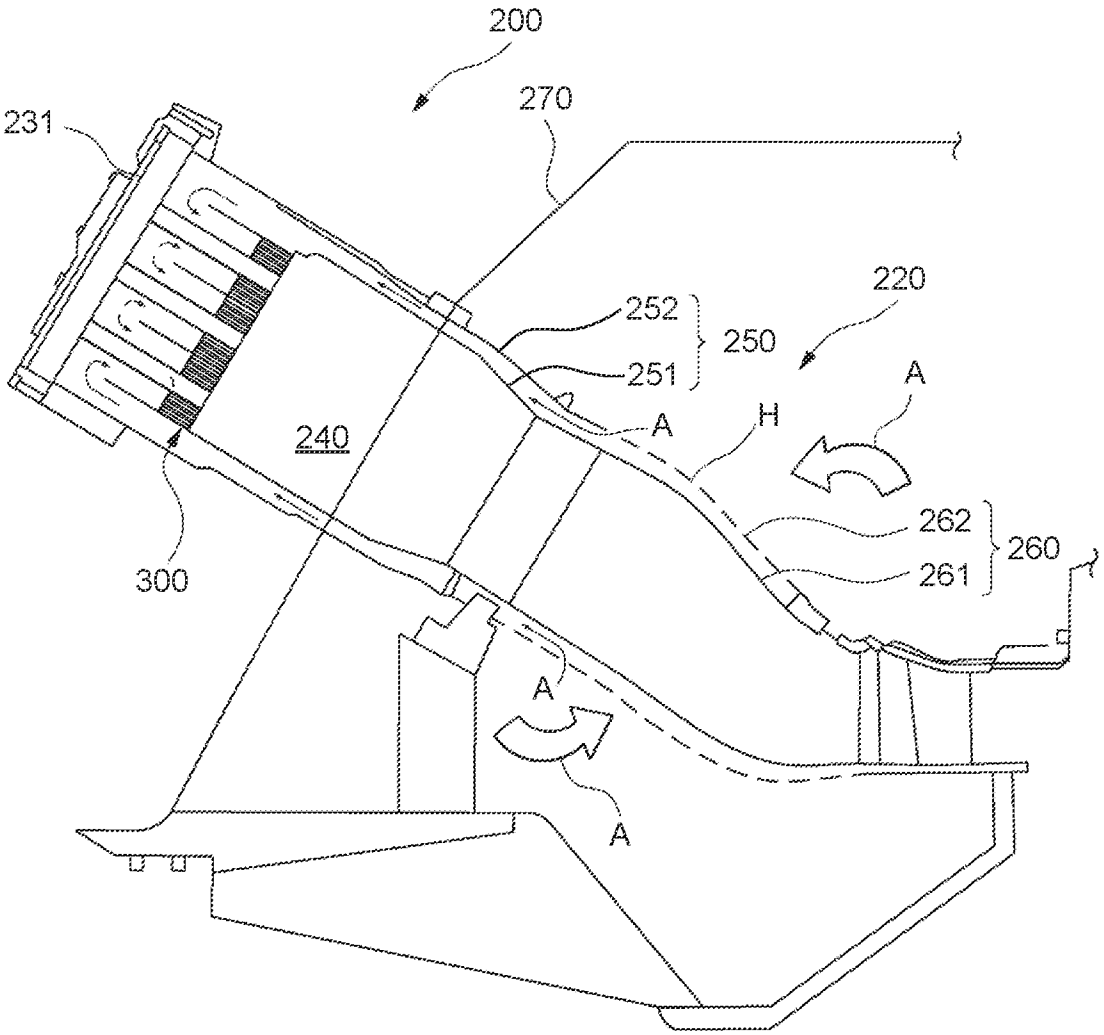
FIG. 2 is a cross-sectional view illustrating a combustor of the gas turbine engine of FIG. 1 according to an embodiment.

Hereinafter, a gas turbine engine according to an exemplary embodiment will be described. FIG. 1 is a perspective view illustrating the interior of the gas turbine engine according to an exemplary embodiment. FIG. 2 is a cross-sectional view illustrating a combustor of the gas turbine engine of FIG. 1 according to an embodiment. Referring to FIGS. 1 and 2, the thermodynamic cycle of the gas turbine engine, which is designated by reference numeral 100, according to the illustrated embodiment may follow a Brayton cycle. The Brayton cycle may consist of four phases including isentropic compression (adiabatic compression), isobaric heat addition, isentropic expansion (adiabatic expansion), and isobaric heat dissipation. In the Brayton cycle, thermal energy may be released by combustion of fuel in an isobaric environment after atmospheric air is sucked and compressed to a high pressure, hot combustion gas may be expanded to be converted into kinetic energy, and exhaust gas with residual energy may then be discharged to the atmosphere. That is, the Brayton cycle may consist of four processes, i.e., compression, heating, expansion, and exhaust.

The gas turbine engine 100 using the above Brayton cycle may include a compressor 110, a combustor 120, and a turbine 130, as illustrated in FIG. 1. Although the following description is given with reference to FIG. 1, the present disclosure may be widely applied to a turbine engine having the same configuration as the gas turbine engine 100 exemplarily illustrated in FIG. 1.

Referring still to FIG. 1, the compressor 110 of the gas turbine engine 100 may suck air from the outside and compress the air. The compressor 110 may supply the combustor 120 with the air compressed by compressor blades 113, and may supply cooling air to a hot region required for cooling in the gas turbine engine 100. In this case, since the air sucked into the compressor 110 is subject to an adiabatic compression process therein, the pressure and temperature of the air that has passed through the compressor 110 increase.

The compressor 110 may be designed as a centrifugal compressor or an axial compressor. In general, the centrifugal compressor is applied to a small gas turbine engine, whereas the multistage axial compressor is applied to the large gas turbine engine 100 as illustrated in FIG. 1 because it is necessary to compress a large amount of air. In the multistage axial compressor, the compressor blades 113 of the compressor 110 rotate along with the rotation of rotor disks to compress air introduced thereinto while delivering the compressed air to rear-stage compressor vanes 114. The air is compressed increasingly to a high pressure while passing through the compressor blades 113 formed in a multistage manner.

A plurality of compressor vanes 113, 114 may be formed in a multistage manner and mounted in a compressor casing 115. The compressor vanes 114 guide the compressed air, which flows from front-stage compressor blades 113, to rear-stage compressor blades 114. In an exemplary embodiment, at least some of the plurality of compressor vanes 114 may be mounted so as to be rotatable within a fixed range for regulating the inflow rate of air or the like.

The compressor 110 may be driven by some of the power output from the turbine 130. To this end, the rotary shaft of the compressor 110 may be directly connected to the rotary shaft of the turbine 130, as illustrated in FIG. 1. In a large gas turbine engine 100, the compressor 110 may require almost half of the power generated by the turbine 100 for driving.

The turbine 130 includes a plurality of rotor disks 131, a plurality of turbine blades radially arranged on each of the rotor disks 131, and a plurality of turbine vanes (not shown). Each of the rotor disks 131 has a substantially disk shape and has a plurality of grooves formed on the outer peripheral portion thereof. The grooves are each formed to have a curved surface so that the turbine blades are inserted into the grooves, and the turbine vanes are mounted in a turbine casing. The turbine vanes are fixed so as not to rotate and serve to guide the direction of flow of the combustion gas that has passed through the turbine blades. The turbine blades generate rotational force while rotating by the combustion gas.

Meanwhile, the combustor 120 may mix the compressed air, which is supplied from the outlet of the compressor 110, with fuel for isobaric combustion to produce combustion gas with high energy. That is, the combustor 120 mixes the compressed air, which is supplied from the outlet of the compressor 110, with fuel for isobaric combustion to produce combustion gas with high energy. The combustor 120 is disposed downstream of the compressor 110 and includes a plurality of burners 200 arranged annularly around a central axis of the gas turbine engine 100.

Referring now to FIG. 2, each of the burners 200 may include a duct assembly 220 having a combustion chamber 240 in which fuel fluid is burned, and a nozzle 300 for injecting the fuel fluid into the combustion chamber 240. The fuel fluid may be supplied from a fuel tank in which fuel (e.g., hydrogen) is stored.

The gas turbine engine may use gas fuel containing hydrogen and/or natural gas, liquid fuel, or composite fuel as a combination thereof, which is the fuel fluid in the present exemplary embodiment. For the gas turbine engine, it is important to make a combustion environment for reducing an amount of emission such as carbon monoxide or nitrogen oxide that is subject to legal regulations. Accordingly, premixed combustion has been increasingly used in recent years in that it enables uniform combustion to reduce emission by lowering a combustion temperature even though it is relatively difficult to control the premixed combustion.

In the case of premixed combustion, after the compressed air introduced from the compressor 110 is mixed with fuel in the nozzle 300, the mixture thereof enters the combustion chamber 240. When combustion is stable after premixed gas is initially ignited by an igniter, the combustion is maintained by the supply of fuel and air.

The duct assembly 220 includes the combustion chamber 240, which is a space for combustion, and further includes a liner 250 and a transition piece 260.

The liner 250 may be disposed downstream of the nozzle 300 and may have a double structure of an inner liner 251 and an outer liner 252. That is, the liner 250 may have a double structure in which the inner liner 251 is surrounded by the outer liner 252. In this case, the inner liner 251 may be a hollow tubular member, and the inside of the inner liner 251 defines the combustion chamber 240. The inner liner 251 may be cooled by the compressed air penetrating into an annular space inside the outer liner 252 through a compressed air inlet hole H.

The transition piece 260 may be positioned downstream of the liner 250, which allows combustion gas produced in the combustion chamber 240 to be released at high speed to the turbine. The transition piece 260 may have a double structure of an inner transition piece 261 and an outer transition piece 262. That is, the transition piece 260 may have a double structure in which the inner transition piece 261 is surrounded by the outer transition piece 262. Like the inner liner 251, the inner transition piece 261 may also be a hollow tubular member. The inner transition piece 261 may have a diameter that gradually decreases from the liner 250 toward the turbine 130. In this case, the inner liner 251 and the inner transition piece 261 may be coupled to each other by a plate spring seal (not shown). The respective ends of the inner liner 251 and the inner transition piece 261 are fixed to the combustor 120 and the turbine, and the plate spring seal has a structure that accommodates an extension in length and diameter due to thermal expansion. As a result, the inner liner 251 and the inner transition piece 261 may be supported.

The outer liner 252 and the outer transition piece 262 may surround the inner liner 251 and the inner transition piece 261, respectively. Compressed air may penetrate into an annular space between the inner liner 251 and the outer liner 252 and an annular space between the inner transition piece 261 and the outer transition piece 262 through the compressed air inlet hole H (the illustrated aspect includes a plurality of holes H). The inner liner 251 and the inner transition piece 261 may be cooled by the compressed air penetrating into the annular spaces.

Meanwhile, the high-temperature and high-pressure combustion gas produced in the combustor 200 is supplied to the turbine 130 through the liner 250 and the transition piece 260. In the turbine 130, the combustion gas applies impingement or reaction force to the turbine blades radially disposed on the rotary shaft of the turbine 130 while expanding adiabatically, so that the thermal energy of the combustion gas is converted into mechanical energy for rotating the rotary shaft. Some of the mechanical energy obtained from the turbine 130 is supplied as energy required to compress air in the compressor, and the rest is utilized as effective energy, such as for driving the power generator to generate electric power.

Referring back to FIG. 2, the compressed air A flowing into the burner 200 is accommodated by a combustor casing 270 and an end cover 231 coupled to each other. The compressed air A may flow into the annular space inside the liner 250 or the transition piece 260 through the compressed air inlet hole H, and then be introduced into nozzle 300 through switching of the direction of flow thereof by the end cover 231.

Figure 3:
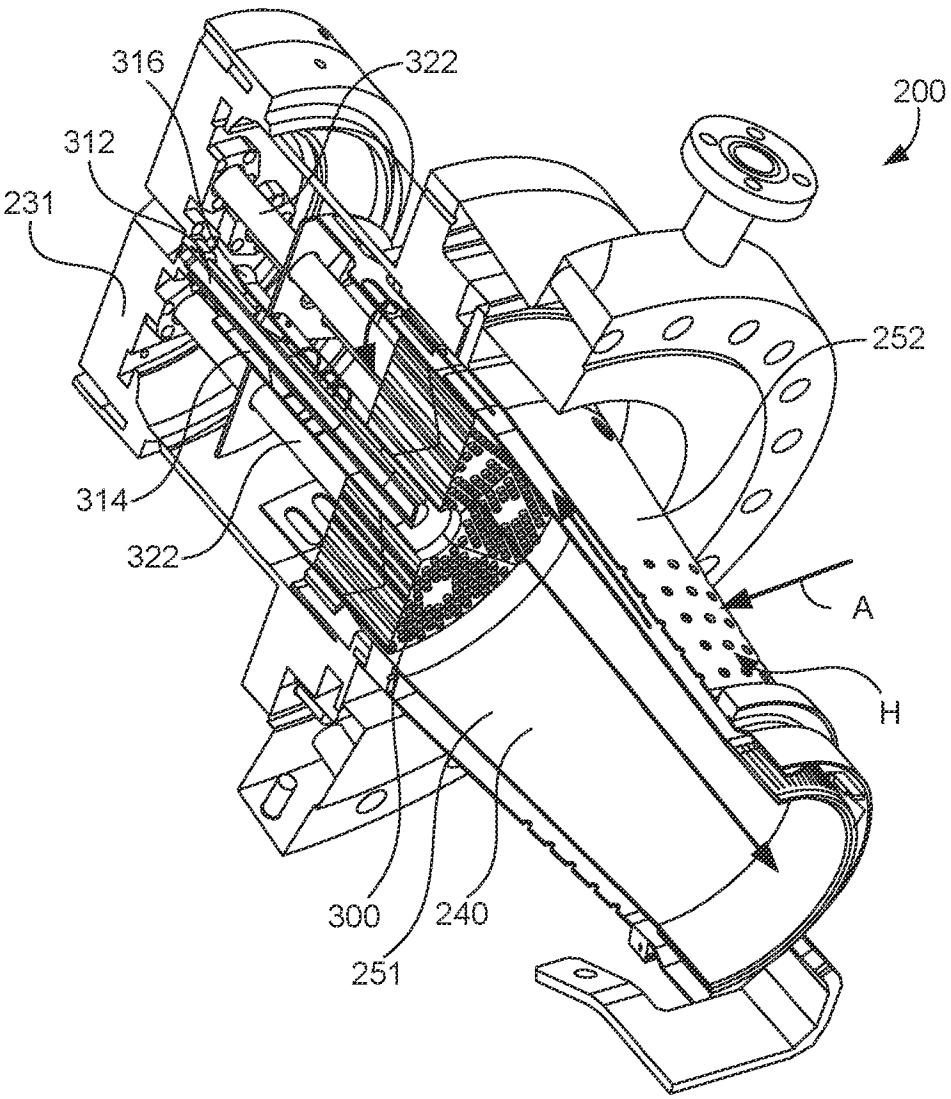
FIG. 3 is a perspective cross-sectional view of components of a gas turbine engine combustor according to an embodiment.

Turning to FIG. 3, a cross-section of a combustor burner 200 is depicted. The burner 200 includes an inner liner 251 that defines a combustion chamber 240 downstream of a nozzle 300. The burner 200 also includes an outer liner 252 that defines an annulus exterior to the inner liner 251 through which compressed air A from the compressor 110 is communicated. The outer liner 252 may include one or more holes H through which compressed air A enters the burner 200. The compressed air A travels towards the end cover 231 until it wraps around the nozzle 300. The compressed air A then passes through the nozzle 300 and is mixed with fuel before being discharged from the nozzle 300 and into the combustion chamber 240.

Figure 4:
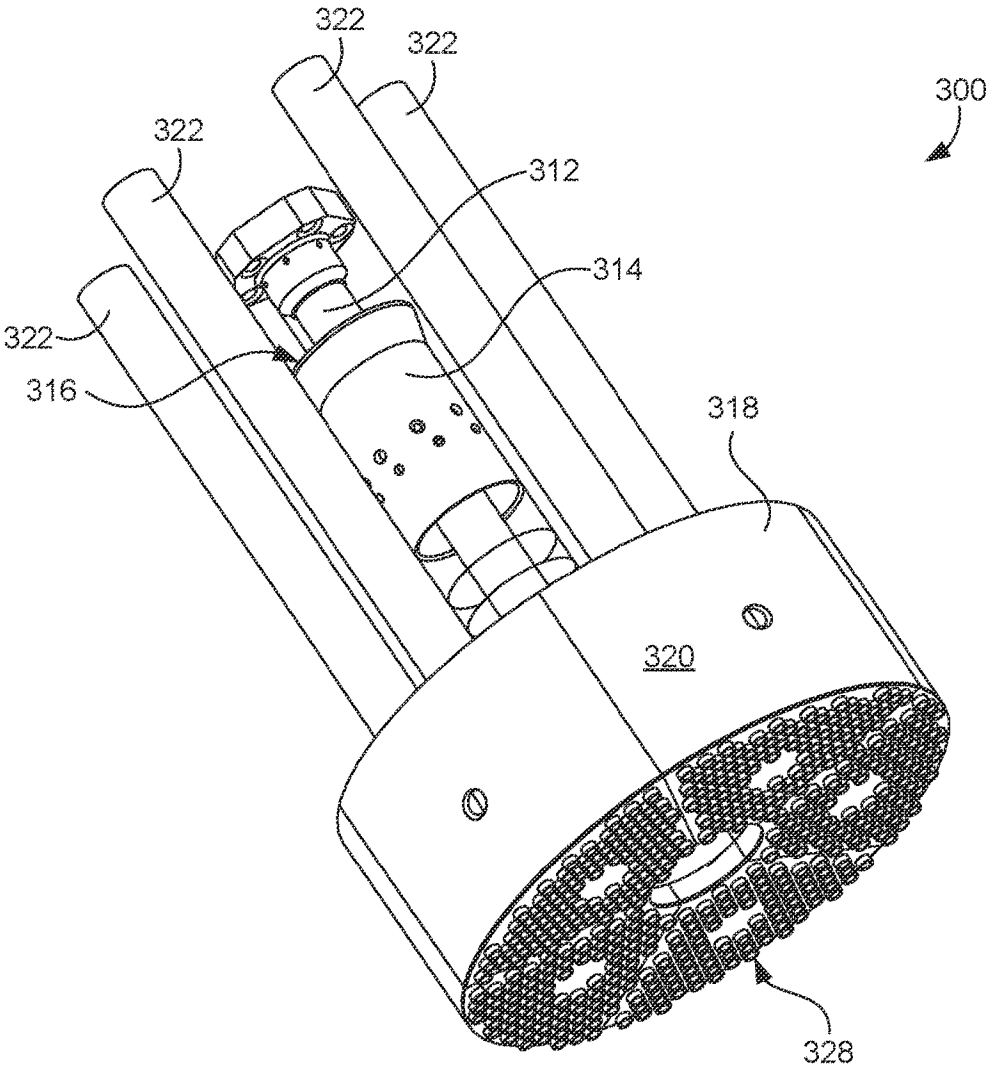
FIG. 4 is a perspective view illustrating a combustor nozzle having a plurality of nozzles disposed therein according to an embodiment.

Referring to FIG. 4, the nozzle 300 may include a central nozzle 310 (e.g., a swirl nozzle) used for start-up or low power operation of the gas turbine engine 100 (e.g., ignition phase, warming phase, up to full-speed no-load phase). The central nozzle 310 may include a central fuel supply line 312 that is in communication with a fuel source and extends through the end cover 231. The central nozzle 310 may also include a central mixing shroud 314 having an air inlet 316 into which compressed air flows. The compressed air mixes with the fuel in the central nozzle 310 and is discharged into the combustion chamber 240 for the above referenced combustion process.

Figure 5:
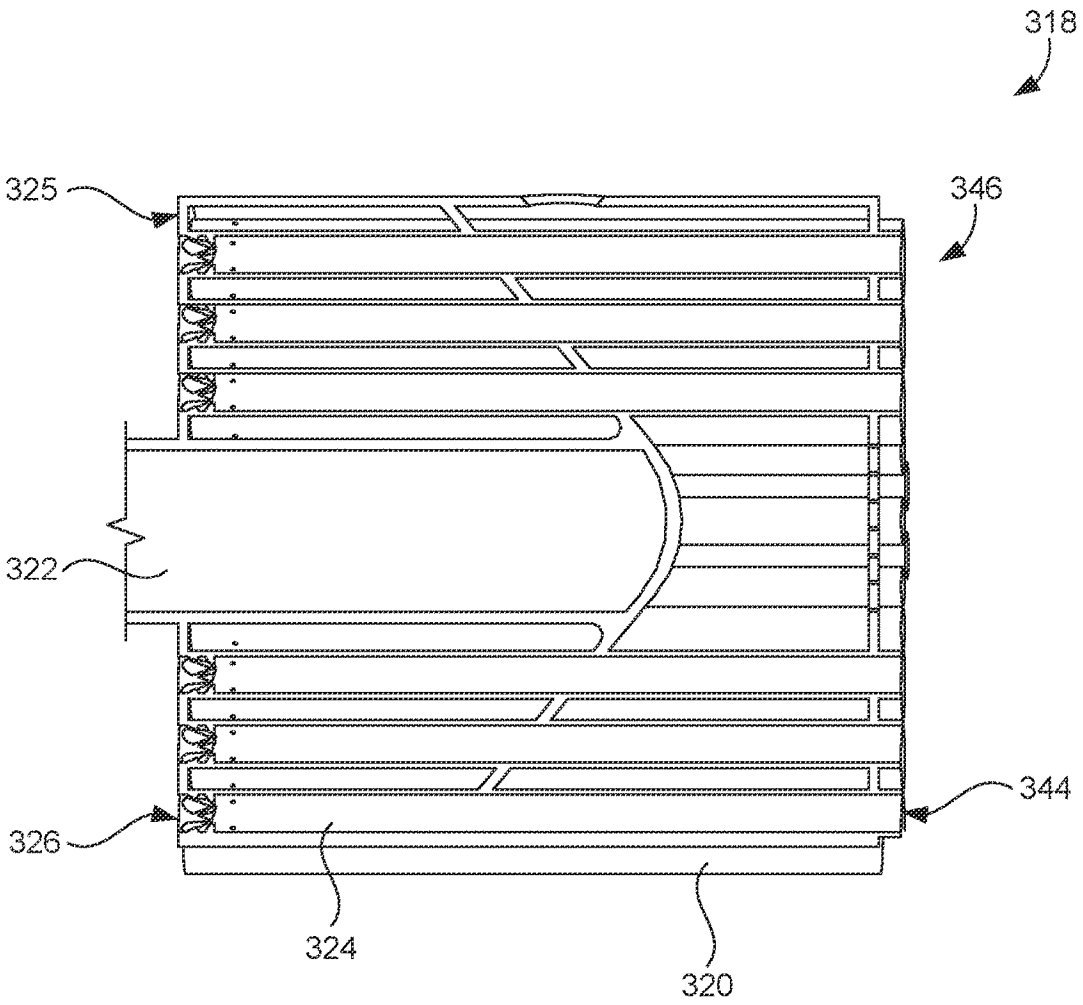
FIG. 5 is a longitudinal cross-sectional view of an outer nozzle according to an embodiment.

The nozzle 300 may also include one or more outer nozzles 318 arranged radially around the central nozzle 310. For example, the illustrated nozzle 300 includes five outer nozzles 318 that may be independently operated based upon a desired power output from the gas turbine engine 100 (e.g., operating two of the outer nozzles 318 may produce 40% load output). Each of the outer nozzles 318 may include a housing 320 that is coupled to one or more of an adjacent housing or the central nozzle 310. Each of the outer nozzles 318 may also include a fuel supply tube 322. The fuel supply tube 322 may extend upstream from the housing 320 to the end cover 231 to receive fuel from a fuel source. Contained within the housing 320 is a plurality of mixing tubes 324. Each of the mixing tubes 324 includes a first opening 326 (see FIGS. 5, 10) on an upstream end 325 of the housing 320 through which compressed air enters. The compressed air is mixed with fuel in the mixing tube 324 and is discharged through a second opening 344 on a downstream end 346 of the housing 320 into the combustion chamber 240 for the above referenced combustion process. The mixing tubes 324 are depicted as integral to the housing 320 to form a unitary structure. In other aspects, the mixing tubes 324 may be coupled to the housing 320 as discrete components.

Figure 6:
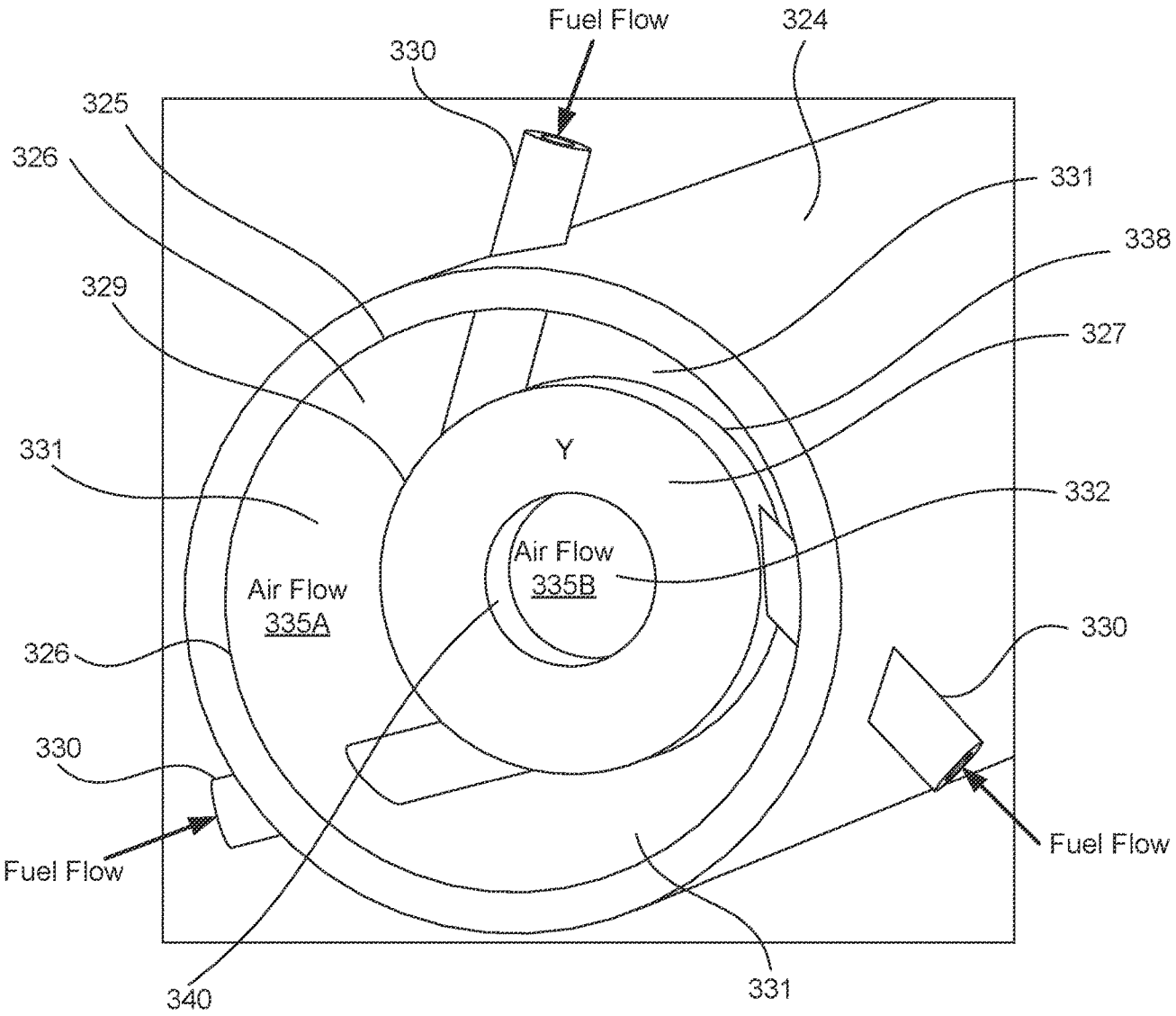
FIG. 6 is a perspective view of a mixing tube having a fuel/air separator according to an embodiment.

FIG. 6 is a perspective view of a mixing tube having a fuel/air separator according to an embodiment. According to this embodiment, the mixing tube 324 is a cylindrical tube through which air and fuel may flow. The mixing tube 324 may have an opening or inlet 326 formed at a longitudinal end 325 for introduction of a first fluid (e.g., compressed air) into the cylindrical tube comprising the mixing tube 324. In addition, the cylindrical mixing tube 324 may have one or more supply ports 330 formed on a circumferential surface of the mixing tube 324 for introduction of a second fluid (e.g., fuel such as hydrogen or fuels containing hydrogen) into the cylindrical mixing tube 324.

According to an aspect of this embodiment, the cylindrical mixing tube 324 includes a fuel/air separator 329 disposed interior of the longitudinal end that is operative to cause a flow of the second fluid (e.g., fuel) to be enveloped by a flow of the first fluid (e.g., compressed air) before the first and second fluids subsequently mix inside the cylindrical mixing tube 324. As will be described in detail below with reference to FIG. 7, the fuel/air separator is comprised of an outer ring-shaped member 338 spaced apart from an inner ring-shaped member 340. With continuing reference to FIG. 6, the space between the outer ring-shaped member 338 and the inner ring-shaped member 340 is covered on the side facing the longitudinal end 325 by a ring-shaped cover plate 327 (described below). Each of the one or more supply ports comprises a tube 330 for communicating the second fluid (e.g., fuel) into the space between the outer and inner ring-shaped members 338, 340 and into the fuel/air separator 329 from outside the cylindrical mixing tube 324.

As described in detail below, the fuel/air separator 329 is operative to cause a first layer of the first fluid (e.g., compressed air) to flow through inlet openings 331 around an outer surface of the outer ring-shaped member 338 of the fuel air separator 329 and into the mixing tube 324 to generate a first layer of the first fluid along an inner surface of the mixing tube 324. A second fluid (e.g., fuel) is introduced into the fuel/air separator 329 through the supply ports 330. The second fluid exits through the back side of the fuel/air separator into the mixing tube 324 and flows into the mixing tube 324 interior of the first layer of the compressed air first fluid flowing along the inner surface of the tube 324. Simultaneously, the first fluid (e.g., compressed air) also enters the inlet 326 of the mixing tube 324 and passes through the orifice 332 of the inner ring-shaped member 340 in the fuel/air separator 329. As the compressed air first fluid passes through the orifice 332, it forms a generally tube-shaped flow of the first fluid so that the fuel flow passing from the fuel/air separator 329 is sandwiched between the flows of the first fluid or compressed air entering through the inlet openings 331 and the orifice 332, respectively. As illustrated in FIG. 6, a ring-shaped cover plate 327 is configured over the front of the fuel/air separator 329 opposite the fuel/air flow through the mixing tube 324 for causing flow of the second fluid (e.g., fuel) through the mixing tube 324 along with the flow of the first and second flows of the compressed air fluid and for preventing flow of the second fluid back through the inlet 326 away from the flow of the first and second flows of the compressed air fluid.

As illustrated and described in detail below with reference to FIG. 10, the fuel/air separator 329 prevents the second fluid (e.g., fuel) from contact with the inner surface of the cylindrical mixing tube 324 until the second fluid mixes with the first and second layers of the first fluid after the first and second fluids pass downrange in the cylindrical mixing tube 324 away from the inlet formed at the longitudinal end of the cylindrical mixing tube 324. As the flows of the compressed air enveloping the flow of the fuel pass through the mixing tube 324, they are thoroughly mixed into a third fluid comprised of the compressed air and the fuel. By insulating the flow of the fuel fluid from contact with the inner surface of the mixing tube 324 until the fuel and compressed air are thoroughly mixed, premature ignition of the fuel fluid is inhibited which reduces fuel combustion flashback and allows for more efficient burning of the fuel/air mixture in the combustor.

Figure 7:
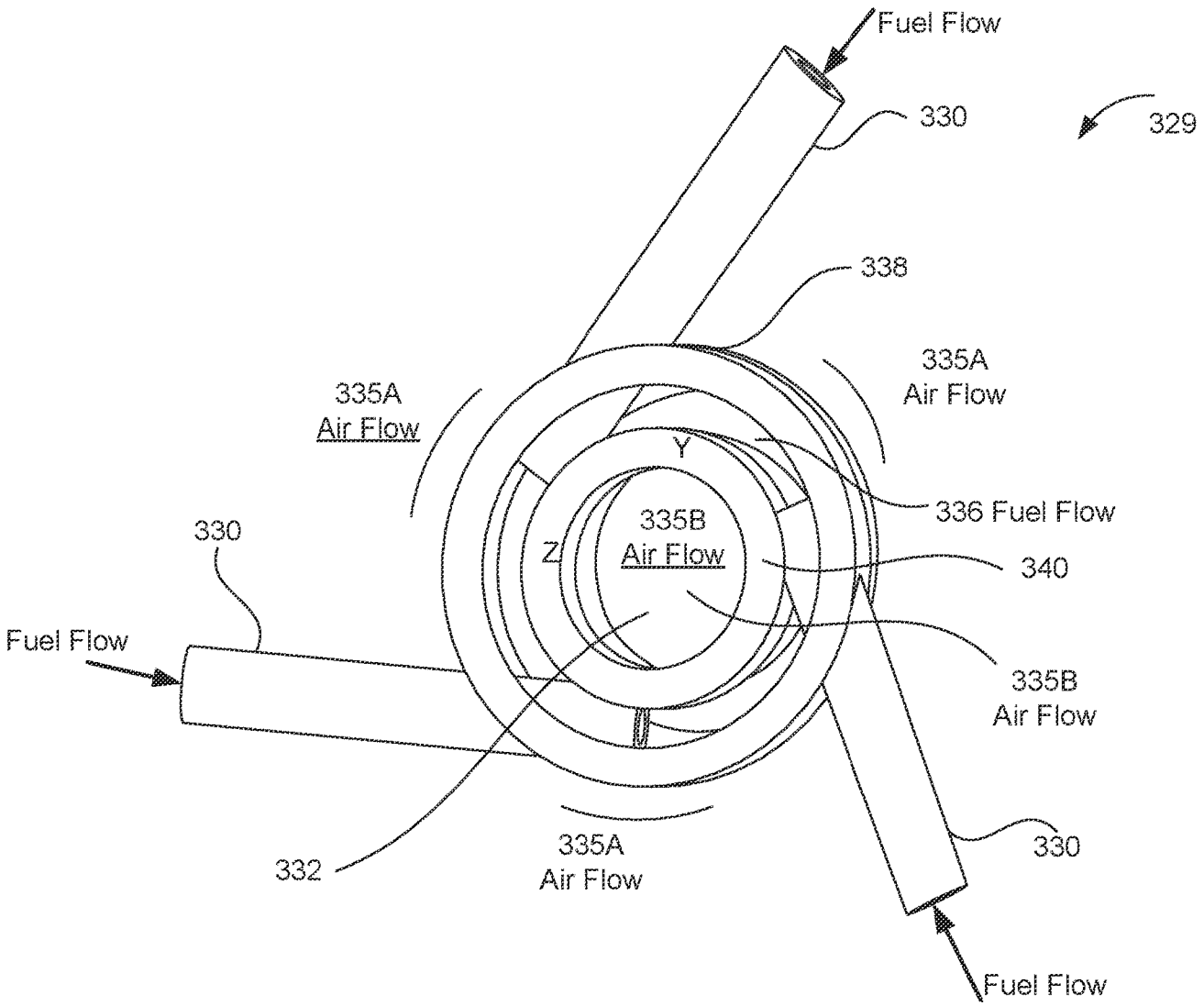
FIG. 7 is a perspective cross-sectional view of a fuel/air separator of FIG. 6 without a fuel/air separator cover according to an embodiment.

Referring now to FIG. 7, exemplary components of the fuel/air separator 329 are illustrated and described. As illustrated in FIG. 7, the fuel/air separator includes an outer ring-shaped member 338, an inner ring-shaped member 340 and a plurality of tubes 330 that terminate in a space between the outer ring-shaped member 338 and the inner ring-shaped member 340. According to an embodiment and as illustrated in FIG. 6, the first fluid (compressed air flow) 335A flows around the outer ring-shaped member between the outer surface of the outer ring-shaped member 338 and an inner surface of the cylindrical mixing tube 340 such that a layer of the first fluid (compressed air 335A) forms along an inner circumferential surface of the cylindrical tube. The inner ring-shaped member 340 includes an orifice 332 for allowing the first fluid (compressed air 335B) to pass through the orifice into the cylindrical tube such that a generally tube-shaped layer of the first fluid passes inside the mixing tube 324.

Referring still to FIG. 7, an outer surface of the inner ring-shaped member 340 is situated spaced-apart from an inner surface of the outer ring-shaped member 338. The space between the inner and outer ring-shaped members 338, 340 forms a ring-shaped cavity into which the second fluid (fuel flow 336) may be passed from the tubes 330 originating outside the circumferential surface of the mixing tube 324 (see FIG. 6).

Referring still to FIG. 7, each of the one or more supply ports includes a tube 330 for communicating the second fluid (fuel flow 336) into the fuel/air separator 329 from outside the cylindrical mixing tube 324. The tubes 330 tube for communicating the second fluid into the fuel/air separator are configured for communicating the second fluid into the space between the inner and outer ring-shaped members and then into the mixing tube 324. According to an embodiment, the tubes 330 may be configured into the mixing tube 324 and into the space between the inner and outer members 338, 340 at an angle best suited for optimizing flow of the second fluid into the fuel/air separator 329. The angle of entry of the tubes 330 illustrated in FIG. 7 is but one example angle of entry that may be utilized to obtain desired fuel flow into the fuel/air separator 329. A different angle of entry for the tubes 330 is illustrated in FIGS. 8 and 9.

In operation, the first fluid (compressed air flow 335A) passes between the outer surface of the outer ring-shaped member 338 and the inner surface of the mixing tube 324, the second fluid (fuel flow 336) passes into the space between the inner and outer members 338, 340 and then into the mixing tube 324, and the first fluid (compressed air flow 335B) passes through the orifice 332 and into the mixing tube 324 to form a generally tube-shaped flow. Thus, the layer of the first fluid (compressed air flow 335A), the layer of the second fluid (fuel flow 336) and the generally tube-shaped layer of the first fluid (compressed air flow 335B) form a fluid flow in the cylindrical mixing tube 324 past the fuel/air separator 329 whereby the layer of the second fluid is sandwiched between the layer of the first fluid and the generally tube-shaped layer of the first fluid such that the second fluid is insulated from the inner circumferential surface of the cylindrical mixing tube 324. Interaction of the layer of the first fluid, the layer of the second fluid and the generally tube-shaped layer of the first fluid downrange in the cylindrical tube away from the inlet formed at the longitudinal end of the cylindrical tube causes the first and second fluids to mix into a third fluid comprised of the first and second fluids (i.e., fuel/air mixture).

Figure 8:
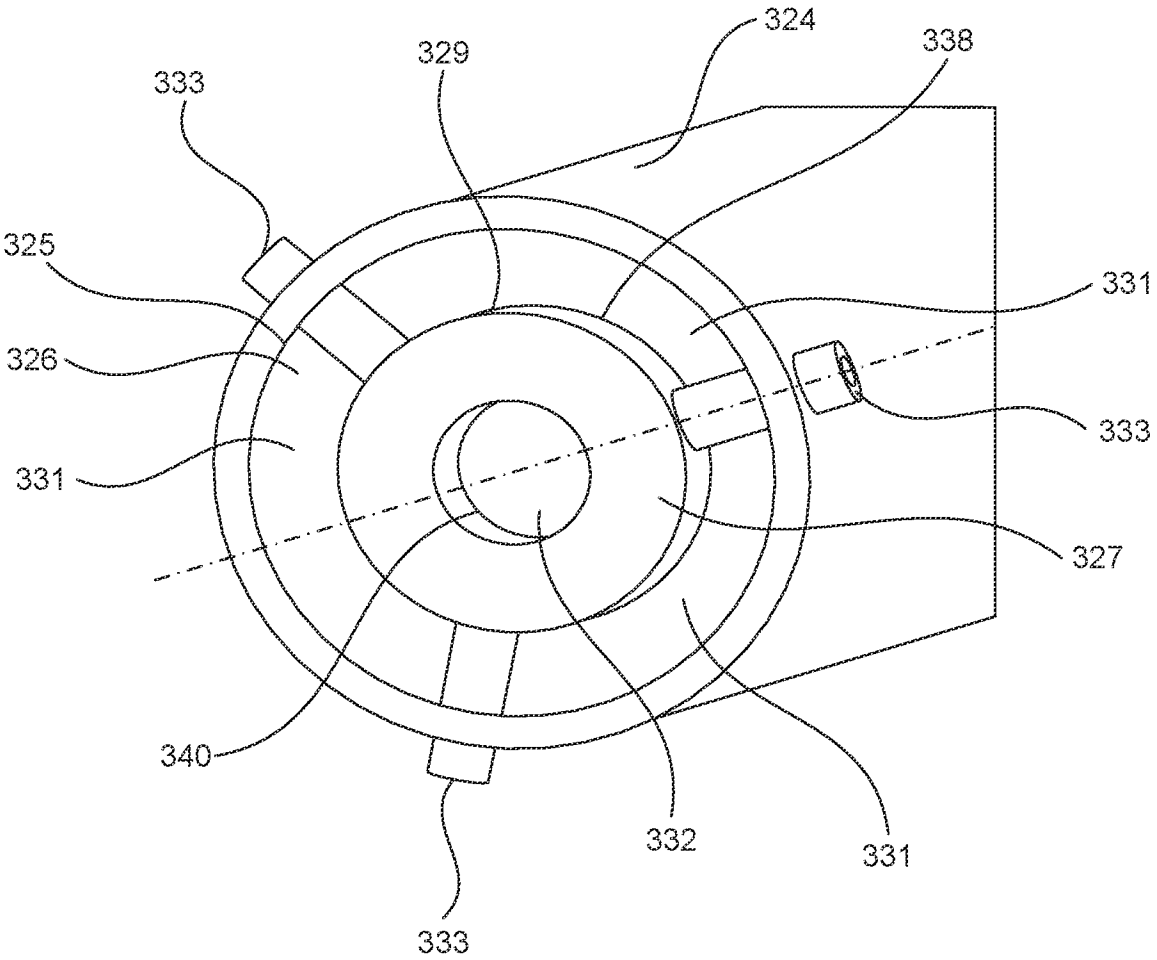
FIG. 8 is a perspective view of a mixing tube having a fuel/air separator according to an alternative embodiment.

FIG. 8 is a perspective view of a mixing tube having a fuel/air separator according to an alternative embodiment. As illustrated in FIG. 8, an alternate configuration for the fuel supply ports (fuel flow tubes 333) is shown. In this example configuration, the tubes 333 enter the mixing tube and ultimately the fuel/air separator 329 perpendicular to the circumferential surface of the mixing tube 324. As discussed above, the angle of entry of the fuel supply ports and associated tubes 330, 333 may be varied to optimize fuel entry into the fuel/air separator 329 according to the fuel/air parameters of a given mixing tube and combustor configuration. The other components illustrated in FIG. 8 are as described above with reference to FIGS. 6, 7.

Figure 9:
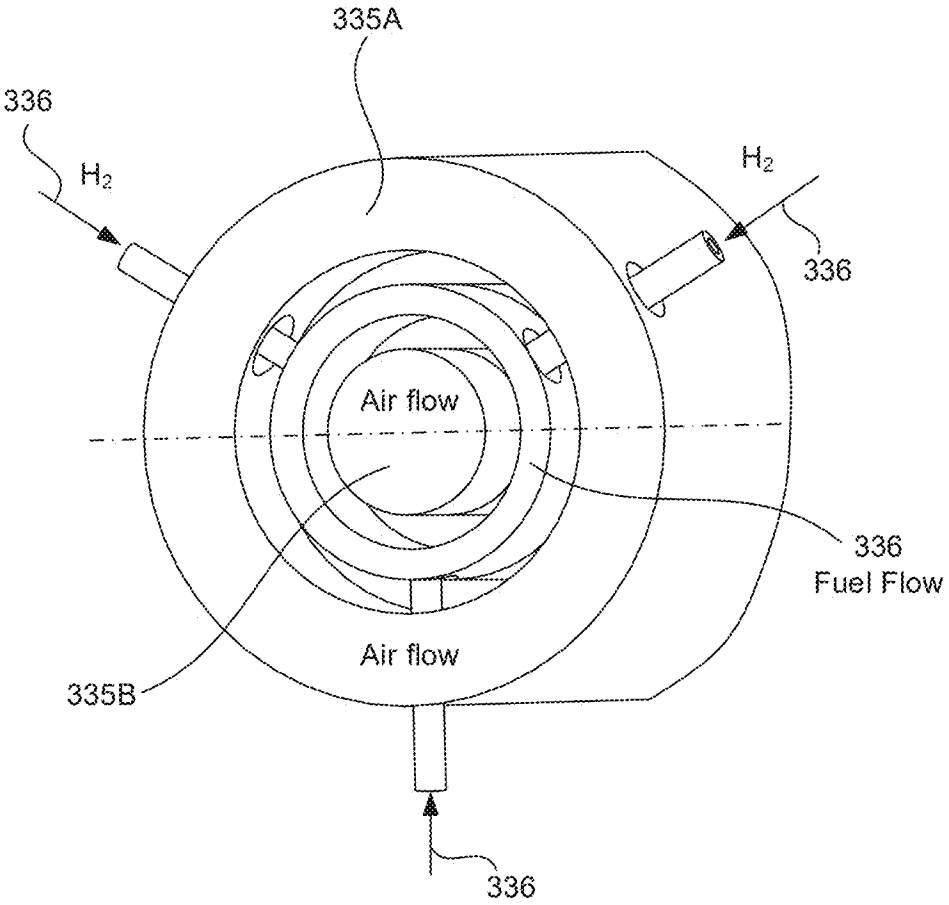
FIG. 9 is a perspective view illustrating fluid flow through the mixing tube of FIG. 8.

FIG. 9 is a perspective view illustrating fluid flow through the cylindrical mixing tube of FIGS. 6-8. The components of the air flow and fuel flow as described herein are illustrated in FIG. 9 after the first fluid (compressed air) and the second fluid (fuel) flows into and through the fuel/air separator 329 described and illustrated with reference to FIGS. 6-8. Referring then to FIG. 9, after the first and second fluids (e.g., compressed air and fuel) enter the mixing tube 324 and fuel/air separator 329 as described above, the first fluid in the form of compressed air enters the mixing tube 324 and past the fuel/air separator 329 by passing between the outer ring-shaped member 338 of the fuel/air separator and into the mixing tube 324. After compressed air passes the outer ring-shaped member 338, a ring-shaped layer of compressed air flow 335A forms along an inner surface of the mixing tube 324. Simultaneously, the fuel 336 enters the fuel/air separator 329 via the supply port tubes 330, 333 and exits out of the back side of the fuel/air separator 329 from the space created between the outer ring-shaped member 338 and the inner ring-shaped member 340 into the mixing tube 324 to form a ring-shaped fuel flow 336B traveling in the same direction as the air flow 335A away from the inlet 326 at the longitudinal end 325 of the mixing tube 324. Also simultaneously, the compressed air first fluid entering the inlet 326 passes through the orifice 332 through the inner ring-shaped member 340 to form a generally tube-shaped air flow 335B passing into the mixing tube 324 and moving in the direction of the air flow 335A and the fuel flow 336B.

Thus, the resulting fluid flow into the mixing tube 324 initially beyond the fuel/air separator 329 includes a ring-shaped air flow 335A traveling along an inner surface of the mixing tube 324, a ring-shaped fuel flow 336B traveling along an inner surface of the layer of air flow 335A, and a generally tube-shaped air flow 335B traveling through the ring-shaped fuel flow 336B. That is, the ring-shaped fuel flow 336B is sandwiched between the ring-shaped air flow 335A and the generally tube-shaped air flow 335B. As described herein, insulating the fuel flow from the inner surface of the mixing tube 324 inhibits premature combustion or flashback of the fuel from contact with the heated inner surface of the mixing tube 324 and thus allows the fuel and compressed air to be thoroughly mixed inside the mixing tube for use as a fuel/air mixture in the gas turbine combustor.

Figure 10:
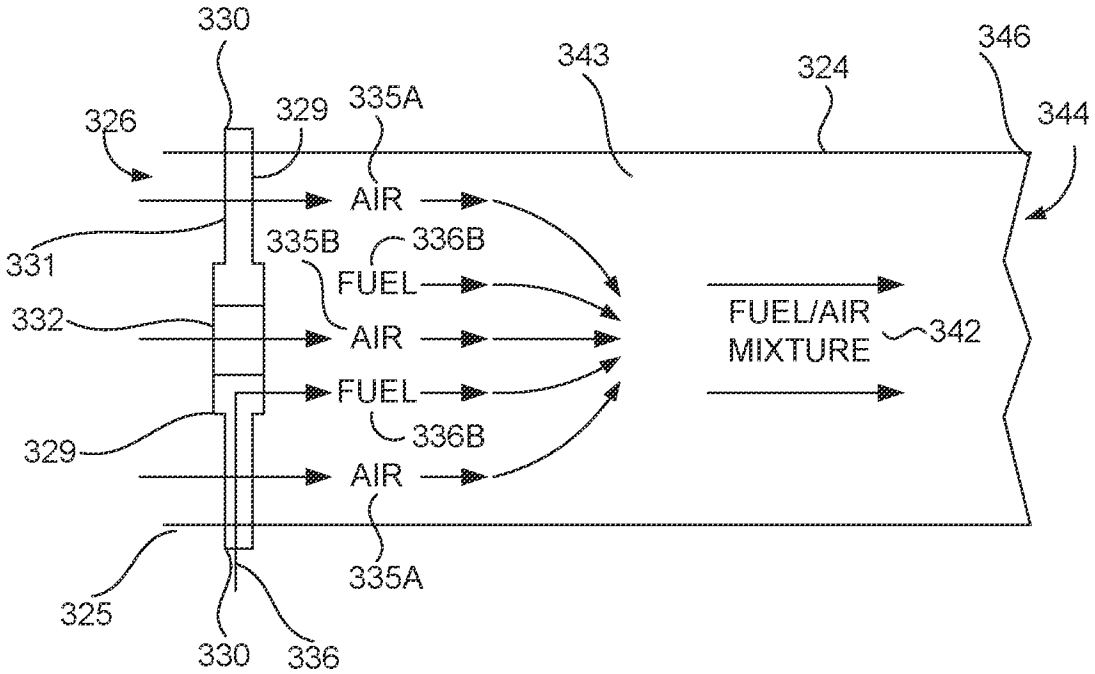
FIG. 10 is a cross-sectional view of the mixing tube of FIGS. 6 and 8 illustrating fluid flow through the fuel/air separator and mixing tube.

FIG. 10 is a cross-sectional view of the mixing tube of FIGS. 6 and 8 illustrating fluid flow through the fuel/air separator and mixing tube. As illustrated in FIG. 10, air flow (first fluid) 335A enters mixing tube 324 inlet 326 at the longitudinal end 325 and passes through inlet 331 between the outer member 338 of the fuel/air separator 329 and an inner surface 343 of the mixing tube 324. Fuel flow 336 enters the fuel/air separator 329 via supply port tubes 330 and then exits the fuel/air separator 329 into the mixing tube 324 inside a ring-shaped air flow 335A. Air flow entering the inlet 326 passes through the orifice 332 of the inner ring-shaped member 340 and exits the fuel/air separator 329 to form a generally tube-shaped air flow 335B traveling inside the ring-shaped fuel flow 336B. As the three fluid components (air flow 335A, fuel flow 336B and air flow 335B) pass through the mixing tube 324, the fuel flow 336B is at least initially sandwiched between the two air flows 335A and 335B. As the three fluid flow components continue through the mixing tube forces of the compressed air traveling around the fuel flow 336B cause a mixing effect which causes the two air flow components to thoroughly mix with the fuel flow component to form a fuel/air mixture 342 that may be passed to the combustor for efficient combustion.

While one or more exemplary embodiments have been described with reference to the accompanying drawings, it will be apparent to those skilled in the art that variations and modifications may be made by adding, changing, or removing components without departing from the spirit and scope of the disclosure as defined in the appended claims, and these variations and modifications fall within the spirit and scope of the disclosure as defined in the appended claims.

What is claimed is:

1. A nozzle for a combustor that burns fuel, comprising:
- a mixing tube through which air and fuel can flow;
- the mixing tube having an inlet formed at a longitudinal end thereof for introduction of a first fluid into the mixing tube;
- the mixing tube having one or more supply ports formed on an outer circumferential surface of the mixing tube for introduction of a second fluid into the mixing tube;
- the mixing tube having at least one fuel/air separator disposed interior of the longitudinal end, the at least one fuel/air separator is operative to cause a flow of the second fluid to be enveloped by a flow of the first fluid before the first fluid and the second fluid subsequently mix inside the mixing tube;
- wherein each of the one or more supply ports comprises a respective cylindrically-shaped tube that extends outwardly from the outer circumferential surface of the mixing tube, each cylindrically-shaped tube being configured to communicate the second fluid from outside the mixing tube to the at least one fuel/air separator.

2. The nozzle according to claim 1, wherein the at least one fuel/air separator is further operative:
- to cause a first layer of the first fluid to flow along an inner surface of the mixing tube;
- to cause a layer of the second fluid to flow along an inner surface of the first layer of the first fluid; and
- to cause a second layer of the first fluid to flow along an inner surface of the layer of the second fluid, whereby the second fluid flows between the first and second layers of the first fluid after the first and second fluids pass through the at least one fuel/air separator.

3. The nozzle according to claim 1, wherein the at least one fuel/air separator prevents the second fluid from contacting the inner surface of the mixing tube until the second fluid mixes with the first and second layers of the first fluid after the first and second fluids pass downstream in the mixing tube away from the inlet formed at the longitudinal end of the mixing tube.

4. The nozzle according to claim 1, the at least one fuel/air separator comprising:
- an outer ring-shaped member, an outer surface of the outer ring-shaped member situated spaced-apart from an inner surface of the mixing tube for allowing passage of the first fluid between the outer surface of the outer ring-shaped member and the inner surface of the mixing tube such that a layer of the first fluid forms along the inner surface of the mixing tube;
- an inner ring-shaped member, an outer surface of the inner ring-shaped member situated spaced-apart from an inner surface of the outer ring-shaped member for allowing passage of the second fluid between the outer surface of the inner ring-shaped member and the inner surface of the outer ring-shaped member such that a layer of the second fluid forms along an inner circumferential surface of the layer of the first fluid; and
- the inner ring-shaped member having an orifice for allowing the first fluid to pass through the orifice into the mixing tube such that a generally cylindrical layer of the first fluid passes inside the layer of the second fluid.

5. The nozzle according to claim 4, wherein the layer of the first fluid, the layer of the second fluid and the generally tube-shaped layer of the first fluid form a fluid flow in the mixing tube past the at least one fuel/air separator whereby the layer of the second fluid is sandwiched between the layer of the first fluid and the generally cylindrical layer of the first fluid such that the second fluid is insulated from the inner surface of the mixing tube.

6. The nozzle according to claim 5, wherein interaction of the layer of the first fluid, the layer of the second fluid and the generally cylindrical layer the first fluid downstream in the mixing tube away from the inlet formed at the longitudinal end of the mixing tube causes the first and second fluids to mix into a third fluid comprised of the first and second fluids.

7. The nozzle according to claim 6, the at least one fuel/air separator having a generally ring-shaped cover plate disposed facing the inlet formed at the longitudinal end, the cover plate covering a space between the inner surface of the outer ring-shaped member and an outer surface of the inner ring-shaped member such that the second fluid entering the at least one fuel/air separator is restricted from flowing back toward the longitudinal end and the second fluid flows downstream in the mixing tube in a direction away from the inlet formed at the longitudinal end of the mixing tube.

8. The nozzle according to claim 7, wherein each cylindrically-shaped tube for communicating the second fluid into the at least one fuel/air separator is configured for communicating the second fluid into the space between the inner surface of the outer ring-shaped member and the outer surface of the inner ring-shaped member.

9. The nozzle according to claim 8, each cylindrically-shaped tube for communicating the second fluid into the separator is further configured to enter the space between the inner surface of the outer ring-shaped member and the outer surface of the inner ring-shaped member at an angle for optimizing flow of the second fluid into the at least one fuel/air separator.

10. The nozzle according to claim 1, wherein the mixing tube is combined with one or more other mixing tubes to form a multi-tube configuration for passing a mixture of the first and second fluids through each of the combined mixing tubes for combustion in a combustor burner.

11. The nozzle according to claim 10, wherein each of the one or more other mixing tubes having an inlet formed at a longitudinal end thereof for introduction of the first fluid into each of the one or more other mixing tubes;

each of the one or more other mixing tubes having one or more supply ports formed on an outer circumferential surface of each of the one or more other mixing tubes for introduction of the second fluid into each of the one or more other mixing tubes; and each of the one or more other mixing tubes having at least one fuel/air separator disposed interior of the longitudinal end, the at least one fuel/air separator operative to cause a flow of the second fluid to be enveloped by a flow of first fluid before the first and second fluids subsequently mix inside each of the one or more other mixing tubes.

12. The nozzle according to claim 1, the first fluid is compressed air and the second fluid is a fuel and whereby interaction of a first layer of the first fluid, a layer of the second fluid and a second layer of the first fluid past the at least one fuel/air separator downstream in the mixing tube away from the inlet formed at the longitudinal end of the mixing tube causes the first and second fluids to mix into a third fluid comprised of the first and second fluids.

13. The nozzle according to claim 12, whereby the fuel is hydrogen.

14. A combustor comprising a burner having a central nozzle and a plurality of outer nozzles arranged radially around the central nozzle for injecting fuel and air, and a duct assembly coupled to one side of the burner to burn a mixture of the fuel and the air therein and transmit combustion gas to a turbine, wherein each of the outer nozzles comprises:

a housing coupled to one or more of an adjacent housing or the central nozzle;

a fuel supply tube coupled to the housing;

a plurality of mixing tubes contained within the housing, through which air and fuel flow, wherein each mixing tube of the plurality of mixing tubes comprises:

an inlet formed at a longitudinal end of the mixing tube for introduction of a first fluid into the mixing tube;

one or more supply ports formed on an outer circumferential surface of the mixing tube for introduction of a second fluid into the mixing tube; and at least one fuel/air separator disposed interior of the longitudinal end, the at least one fuel/air separator operative to cause a flow of the second fluid to be enveloped by a flow of the first fluid before the first fluid and the second fluid subsequently mix inside the mixing tube.

15. The combustor according to claim 14, the at least one fuel/air separator comprising:

an outer ring-shaped member, an outer surface of the outer ring-shaped member situated spaced-apart from an inner surface of the mixing tube for allowing passage of the first fluid between the outer surface of the outer ring-shaped member and the inner surface of the mixing tube such that a layer of the first fluid forms along the inner surface of the mixing tube;

an inner ring-shaped member, an outer surface of the inner ring-shaped member situated spaced-apart from an inner surface of the outer ring-shaped member for allowing passage of the second fluid between the outer surface of the inner ring-shaped member and the inner surface of the outer ring-shaped member such that a layer of the second fluid forms along an inner circumferential surface of the layer of the first fluid; and the inner ring-shaped member having an orifice for allowing the first fluid to pass through the orifice into the mixing tube such that a generally cylindrical layer of the first fluid passes inside the layer of the second fluid.

16. The combustor according to claim 15, the layer of the first fluid, the layer of the second fluid and the generally cylindrical layer of the first fluid form a fluid flow in the mixing tube past the at least one fuel/air separator whereby the layer of the second fluid is sandwiched between the layer of the first fluid and the generally cylindrical layer of the first fluid such that the second fluid is insulated from the inner surface of the mixing tube; and wherein the plurality of outer nozzles are combined to form a multi-tube configuration for passing a mixture of the first and second fluids through each of the combined nozzles to a combustion chamber of the combustor.

17. The combustor according to claim 16, each of the one or more supply ports comprising a respective cylindrically-shaped tube for communicating the second fluid into the at least one fuel/air separator from outside the mixing tube whereby each cylindrically-shaped tube is configured for communicating the second fluid into a space between the inner surface of the outer ring-shaped member and the outer surface of the inner ring-shaped member at an angle for optimizing flow of the second fluid into the at least one fuel/air separator.

18. A gas turbine engine comprising a compressor configured to compress air introduced thereinto, a combustor configured to mix fuel with the air compressed by the compressor for combustion, and a turbine having a plurality of turbine blades rotated by combustion gas produced by the combustion in the combustor, wherein the combustor comprises a burner having a central nozzle and a plurality of outer nozzles arranged radially around the central nozzle for injecting the fuel and the air, and a duct assembly coupled to one side of the burner to burn a mixture of the fuel and the air therein and transmit the combustion gas to the turbine, wherein each of the outer nozzles comprises:

a housing, the housing having an upstream surface separated from a downstream surface, the upstream surface having a plurality of inlet openings and the downstream surface having a plurality of outlet openings;

a plurality of mixing tubes extending from the upstream surface to the downstream surface, each mixing tube of the plurality of mixing tubes aligned with a respective inlet opening formed at a longitudinal end of the mixing tube and each mixing tube aligned with a respective outlet opening, each inlet opening for communicating a first fluid into each mixing tube extending through the outer nozzle;

each mixing tube of the plurality of mixing tubes having:

one or more supply ports formed on an outer circumferential surface of the mixing tube for introduction of a second fluid into the mixing tube; and at least one fuel/air separator disposed interior of the longitudinal end, the at least one fuel/air separator operative to cause a flow of the second fluid to be enveloped by a flow of the first fluid before the first fluid and the second fluid subsequently mix inside the mixing tube.

19. The gas turbine engine according to claim 18, wherein the at least one fuel/air separator is further operative to prevent the second fluid from contact with an inner surface of the mixing tube until the second fluid thoroughly mixes with a first layer and a second layer of the first fluid after the first fluid and the second fluid pass downstream in the mixing tube in a direction away from the inlet formed at the longitudinal end of the mixing tube.

* * * * *